US005237713A

United States Patent [19]

Prager

[11] Patent Number: 5,237,713

[45] **Date of Patent: * Aug. 24, 1993**

[54] LOUNGE CUSHIONS

[76] Inventor: Howard A. Prager, 191 Hamburg Turnpike, Pompton Lakes, N.J. 07442

[ * ] Notice: The portion of the term of this patent subsequent to Jul. 17, 2007 has been disclaimed.

[21] Appl. No.: 553,716

[22] Filed: Jul. 16, 1990

Related U.S. Application Data

[63] Continuation-in-part of Ser. No. 111,782, Oct. 21, 1987, Pat. No. 4,941,222.

[51] Int. Cl.[5] ..... A47C 20/00

[52] U.S. Cl. ..... 5/465; 5/461; 5/648; 5/636; 5/632; 5/900.5

[58] Field of Search ..... 5/431, 435, 436, 437, 5/446, 461, 465, 110, 111, 443; 297/397, 410

[56] References Cited

U.S. PATENT DOCUMENTS

| | | | |
|---|---|---|---|
| Re. 19,355 | 10/1934 | Gursky et al. | 5/465 |
| 1,537,914 | 5/1925 | Darling | 5/431 X |
| 2,905,230 | 9/1959 | Gabriel | 297/410 |
| 3,897,102 | 7/1975 | Lemaire | 5/431 X |
| 4,207,635 | 6/1980 | Leroy | 5/446 X |
| 4,382,306 | 5/1983 | Lickert | 5/465 |
| 4,474,370 | 10/1984 | Oman | 5/446 X |
| 4,723,329 | 2/1988 | Vaccaro | 5/435 X |
| 4,876,755 | 10/1989 | Parrish | 5/431 |
| 4,941,222 | 7/1990 | Prager | 5/446 X |

*Primary Examiner*—Michael F. Trettel
*Attorney, Agent, or Firm*—Richard T. Laughlin

[57] ABSTRACT

This invention relates to a lounge cushion with body supports which are adjustable to conform with body frames of different girths and heights. It is ergonomically correct to alleviate stress on the lower back, head, neck and legs by reducing pressure while relaxing in the prone, supine or side laying positions.

5 Claims, 2 Drawing Sheets

LOUNGE CUSHIONS

BACKGROUND OF THE INVENTION

This application is a continuation-in-part of parent application Ser. No. 07/111,782, filed Oct. 21, 1987, of the same inventor, now U.S. Pat. No. 4,941,222.

While the typical lounge and/or beach chair is designed for the user to lie only on their back, it fails to keep the body's normal biomechanics in mind. Proper support must be used in the lumbar and cervical spine to alleviate any uneven pull and fatigue of the spinal musculature. These problems occur when one attempts to lie on their stomach or on a side laying position on a chair/lounge of any type currently in existence.

Many individuals have difficulty in sleeping or resting comfortably in a face down or face up position. A number of devices have been suggested to overcome this problem. One of the major difficulties is that the proportions or size of users of such equipment vary widely and as a result the design of a suitable resting surface is made to accommodate the average frame which makes it unsuitable for most users.

A large number of tables and lounges have been devised which give various types of support to the body. Typical of such designs is a sun tanning lounge disclosed in U.S. Pat. No. 4,207,635 issued Jun. 17, 1980 to Michael Leroy which is designed for the vertical and/or dorsal decubitus. In accordance with such patent vertical or dorsal support is given by providing a converse surface on which the abdomen can rest when the user is in a face down elongated or prone position and a converse surface by reversing the structure when the user is facing upward. In certain configurations the lounge can be placed on an incline and a cutout made where the users face and protrude when on his abdomen. A similar chiropractic table is shown in U.S. Pat. No. 3,747,916 issued Jul. 24, 1973 to John S. Benson.

U.S. Pat. No. 1,194,112 issued Aug. 8, 1916 to W. S. & D. E. Wood discloses a collapsible, manipulating table by doctors or chiropractors. This table is provided with a flexible section for anterior curvature of the abdominal portion of the human body when lying in a prone position. In U.S. Pat. No. 3,828,377 issued Aug. 13, 1974 to George D. Fary an adjustable body rest is disclosed which intended to support the human body when lying in a face down position. A head or face rest is provided having an open portion for the nose and mouth in combination with a chest or shoulder support which is adjustable to different body dimensions. A some what similar construction is shown in U.S. Pat. No. 3,808,615 issued on May 7, 1974 to William M. Geary.

A bag lounge is disclosed in U.S. Pat. No. 2,910,707 issued Nov. 3, 1959 to M. L. Lawser and Florence J. Schippert. The bag contains two hollow elements which are curved transversely as to permit their use as a headrest and a knee support. The user separates the two supports a distance to conform with his or her comfort level and lays them on the ground. A mattress pad is disclosed in U.S. Pat. No. 1,045,228 issued Nov. 26, 1912 to T. C. Weltmer which is provided with a stuffed section which fits under the curvature of a person sleeping on his or her side.

OBJECTS OF THE INVENTION

An object of the invention is to provide a lounge cushion allowing support in both the ventral and dorsal and side positions.

Another object of the invention is to provide such a lounge cushion which is portable.

Still another object is to provide a cushion which can be used on most of the prior art lounge chairs.

A further object of the invention is to provide such a lounge cushion which is readily adjustable to provide proper support for users of different sizes and shapes.

Other objects and the advantages of the invention will appear from the following description.

SUMMARY OF THE INVENTION

In accordance with the invention, a unique lounge cushion is presented that solves all of the comfort and biomechanical problems of previous furniture and cushion types. This lounge cushion gives proper cervical, lumbar and leg support when lying on one's back. Additionally, it solves the many structural problems of lying on the stomach or side by using a prone-face opening, an abdominal/lumbar support, and an ankle support to diminish low back pressure. The lounge cushion has the ability to completely flatten so as to afford the user the stability lie on their stomach. The slidable neck and knee supports are able to accommodate variable body frame and types.

The lounge cushion is provided with upholstered supports for giving cervical support to the neck and for the legs which can be adjusted in the plane of the body for use with bodies of various height and dimensions. It also can provide support for the abdomen and ankles when utilized in the face down position. The lounge is particularly effective when laying in a side position. Further the lounge cushion of the invention can be provided with an opening for the face to allow ease of use when laying on the stomach in the prone position. As is seen the lounge of the invention is a simple method of giving full and comfortable support to the user of the lounge cushion.

THE DRAWINGS

DETAILED DESCRIPTION OF THE INVENTION

Figure 1:
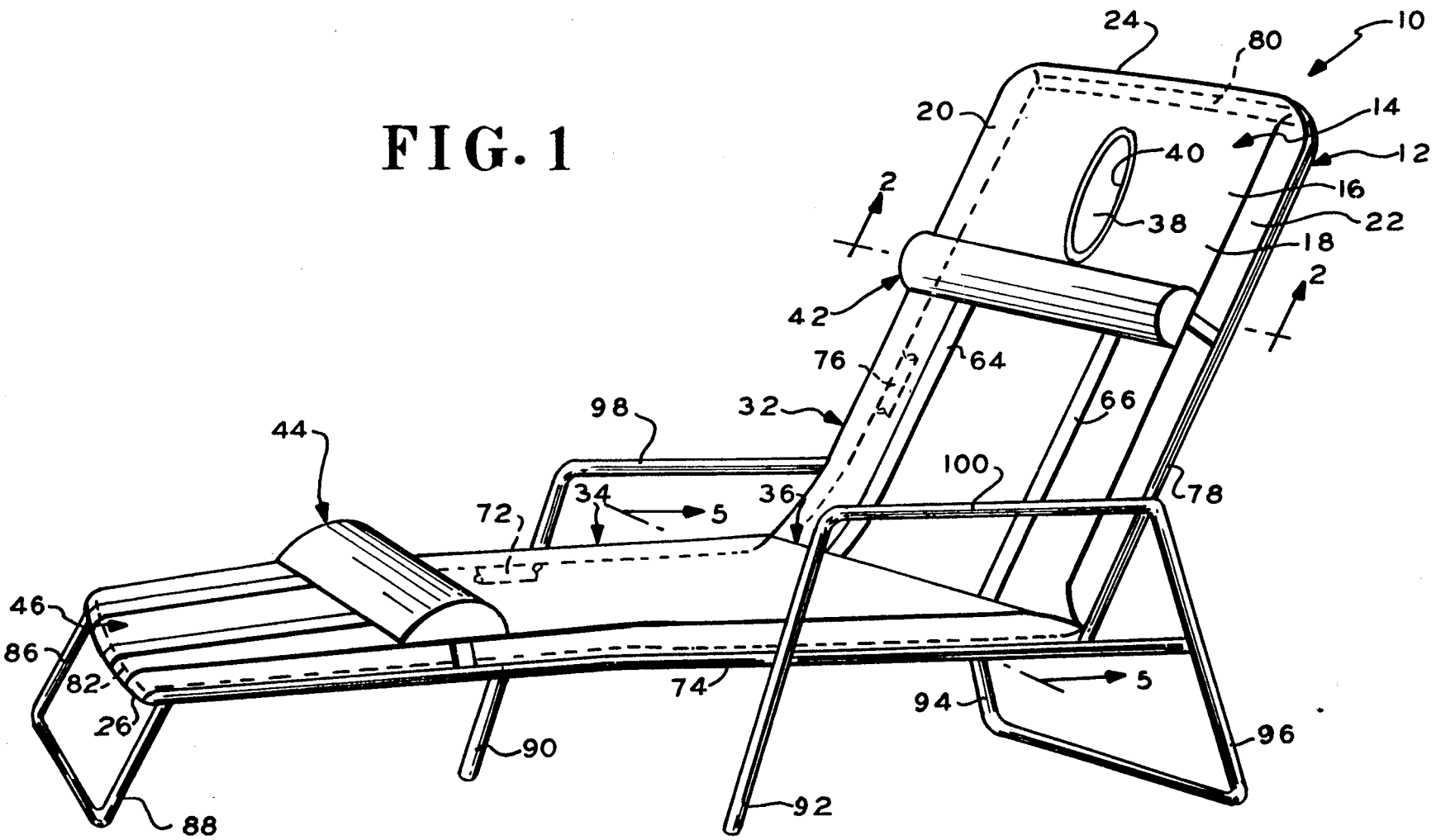
FIG. 1 represents a view in perspective of a first embodiment of the lounge cushion of the invention and on cushion support framework.
Figure 2:
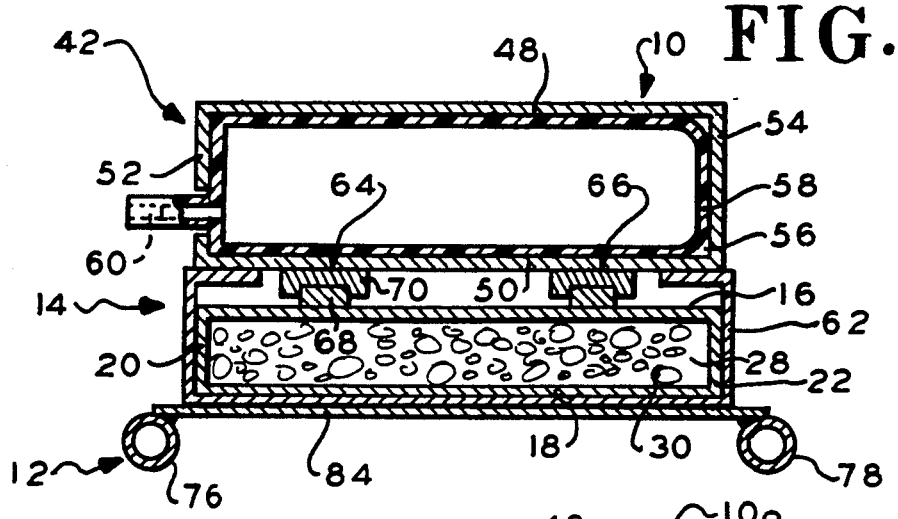
FIG. 2 is a cross sectional view as taken along the line 2—2 of FIG. 1.

As shown in FIGS. 1 and 2, a lounge 10 is provided. Lounge 10 has a chair or framework 12, and a cushion 14 which is supported by framework 12. Cushion 14 has a top cover or sheet 16, a bottom sheet 18, a left side sheet 20, a right side sheet 22, an upper end sheet 24 and a lower end sheet 26, all of which enclose a cavity 28 that contains a filler 30. Each sheet is stitched along its edges.

Cushion 12 has an upper part 32, a lower part 34, and a fold line or stitched joint 36, which is disposed there between. A region around joint 36 supports a person's abdomen when a person lies thereon. Upper part 32 has an aperture or opening 38, which has an edge portion 40 that surrounds opening 38. Edge 40 supports a person's head. Upper part 32 also has a neck support 42 for supporting the neck when lying back and it can slide down to become abdominal support when laying face down. Lower part 34 has a knee support 44, which supports the knee when lying back. Lower part 34 also has a support region adjacent to lower end sheet 26 for supporting a person's ankles and can slide downward when face down.

As shown in FIGS. 1 and 2, neck support 42, which is identical in construction to knee support 44, has an arcuate upper sheet or cover 48, a lower flat cover 50, a left end cover 52, a right end cover 54, which together enclose a space 56 that contains an inflatable balloon or tube 58 that has an air valve 60. Neck support 42 has an elastic band 62, which bears against sheets 18, 20, 22 and which is fixedly connected at each end thereof to sheet 50. Neck support 42 also has two elongate guide strips 64, 66. Strip 64, which is identical to strip 66 in construction, has a first part 68, which is fixedly connected to sheet 16, and a second part 70, which is fixedly connected to sheet 50.

When a person or user is lying on his back, neck support 42 bears against the back of the neck and knee support 44 bears against the back of the knee. When a user is lying face down on his front, neck support 42, after repositioning it, bears against the abdomen or belly, and knee support 44, after repositioning it, bears against the front of the ankles. Neck support 42 and knee support 44 are so named, for ease of visualization of supports 42, 44, relative to a user lying on his back.

Figure 3:
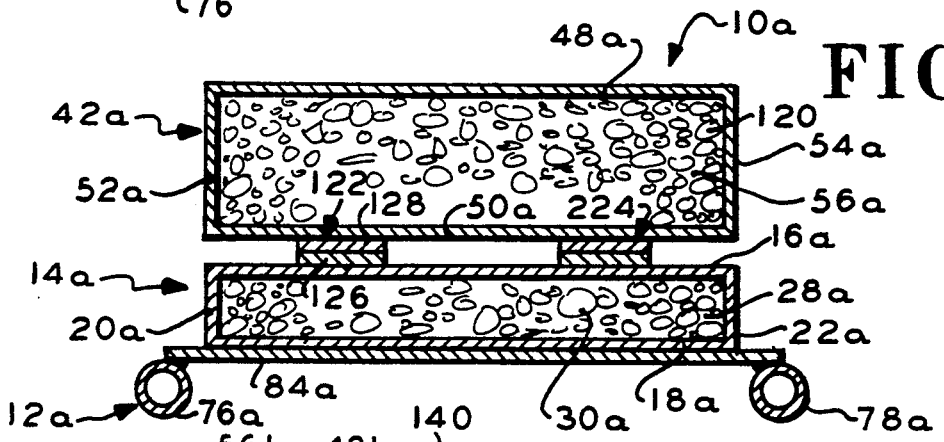
FIG. 3 is a cross sectional view corresponding to FIG. 2 showing a second embodiment of the invention.

As shown in FIG. 3, a second embodiment **10*a* is provided. Parts of second embodiment 10*a*, which are the same as corresponding parts of first embodiment 10, have the same numerals but with a subscript "a" added thereto. Lounge 10*a* has a framework 12*a* and a cushion 14*a*. Cushion 14*a* has top and bottom sheets 16*a*, 18*a*, side sheets 20*a*, 22*a*, which enclose a cavity 28*a* that contains a filler 30*a*. Cushion 14*a* has a neck support 42*a* and a knee support (not shown) which is identical in construction to neck support 42*a***.

Neck support **42*a* has an arcuate cover 48*a*, a flat cover 50*a*, and end covers 52*a*, 54*a*, which enclose a space 56*a* that contains a fill material 120. Fill 120 is made of the same material as the material of cushion filler 30*a*. Neck support 42*a* also has first and second elongate strips 122, 124. Strip 122, which is identical in construction to strip 124, has a first part 126 which is fixedly connected to cushion sheet 16*a*, and has a second part 128 which is fixedly connected to cover 50*a*. Parts 126, 128 are each made of a material, which has a surface with minute, hook and eye fibers, and which is sold under the trademark "VELCRO". Framework 12*a* has inclined side bars 76*a*, 78*a*, and has a plurality of welded transverse pieces 84*a***; and horizontal pieces and end pieces and leg pieces (not shown).

Figure 4:
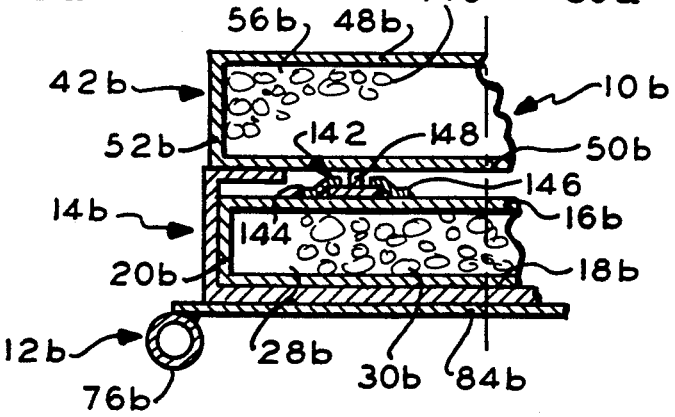
FIG. 4 is a cross sectional view corresponding to FIG. 2 showing a third embodiment of the invention.

As shown in FIG. 4, a third embodiment **10*b* is provided. Parts of embodiment 10*b* which are the same as corresponding parts of embodiment 10 have the same numerals, but with a subscript "b" added thereto. Lounge 10*b* has a framework 12*b* and a cushion 14*b*. Cushion 14*b* has top and bottom sheets 16*b*, 18*b*, end sheet 20*b*, an opposite end sheet (not shown), which enclose a cavity 28*b* that contains a filler 30*a*. Cushion 14*b* has a neck support 42*b***.

Neck support **42*b* has an arcuate cover 48*b*, a flat cover 50*b*, an end cover 52*b*, and another end cover (not shown), which forms a space 56*b*, that contains a fill material 140. Fill material 140 is a material like the material of filler 30. Strip 142 has track parts 144, 146 which are fixedly connected to sheet 16*b*, and has a T-shaped part 148, which is fixedly connected to cover 50*b***.

Framework **12*b* has a inclined side bar 76*b*, another inclined side bar (not shown) and a plurality of transverse welded members 84*b***.

Figure 5:
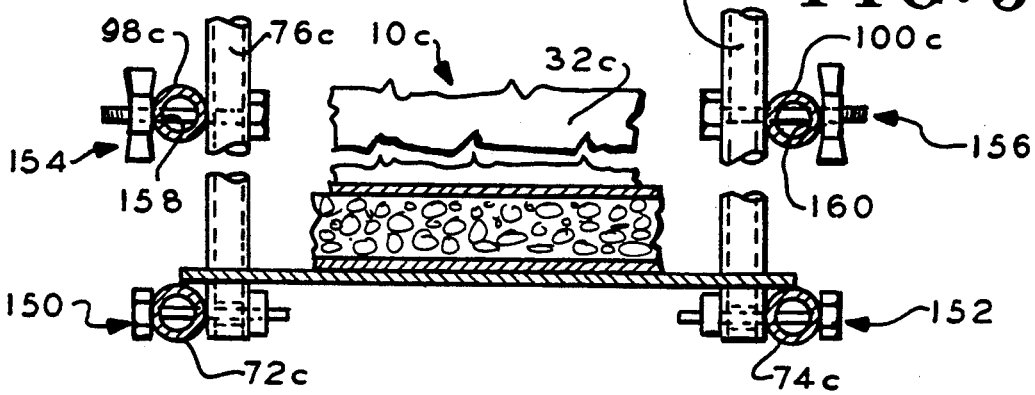
FIG. 5 is a cross sectional view as taken along the line 5—5 of FIG. 1.

As shown in FIG. 5, a fourth embodiment **10*c* is provided. Parts identical to first embodiment 10 have the same numerals, but with a subscript "c" added thereto. Inclined members 76*c*, 78*c* respectfully have hinge connections 150, 152, and lock connections 154, 156. Arm rests 98*c*, 100*c* respectfully have a plurality of axially aligned holes 158, 160 for setting the angle of inclination of cushion upper part 32*c***.

Cushion 14 of the invention gives a comfortable decubitus or lying down both in the ventral or abdominal or belly position and dorsal or back position and is so ergonomically correct that it can help to alleviate stress on the lower back, head, neck and legs by reducing pressure while relaxing. Cushion 14 is preferably about seventy-two inches in length and about twenty three inches in width and about four inches in thickness. In order to accomplish the desired result it is provided with a neck support or supine cervical upper support when the user is lying on his back, which is slidable in the plane of the cushion 14 to become an abdominal/-lumbar support when the user is in a prone or face down position. The support 42 is preferably slidable for about half the length of the entire cushion, usually thirty six inches extending from about twelve inches from the top or head of the cushion 14. This support 42 is preferably convex in shape, with a maximum of five inches in height but it can be cylindrical. The support 42 extends across the width of the cushion 14 and is preferably four inches in width, approximately twenty-three inches in length across the cushion, and about four inches at its maximum convex height curving to a relatively thin layer at each side. This support 42 contains a filler 58 which is preferably an inflatable tube, or which alternatively can be upholstered material such as polyurethane cushion. Tube 58 has an adjustable firmness. The knee support or second, lower support 44 is provided for the supine popliteal area or when used in the prone position ankle support which is also slidable in the plane of the cushion 14. This support prevents strain on the lower back. This second support 44 also has a convex shape extending across the cushion 14 and preferably about the same size as the first support. It is constructed in a manner similar to the supine cervical or neck support 42.

As indicated, a particular feature of the invention is that the two supports 42, 44 are adjustable so that they fit the particular frame and weight of the user. This is accomplished in the first embodiment by using an elastic band or guide strips 64, 66. In the second embodiment; strips 122, 124 which are sold under the trademark VELCRO are used. Another embodiment which has a method securing the supports 42, 44 to the top sheet of the cushion 14 is shown in FIG. 4. In this arrangement the support indicated at 146 in FIG. 4 has "T" shaped flanges 148 which are affixed to the bottom of each support 42, 44 with the upper bar of the T being in the lower position. The "T" shaped member 148 can be made of any stiff material such as reinforced fabric or even metal such as aluminum. The upper bar of the T of the flanges rides in tracks 144, 146 which have an opening big enough to accommodate the thickness of the stem of the T, but small enough to hold the upper bar of the T in the channel. The tracks 144, 146 can be formed of fabric sewn or otherwise attached to the surface of the cushion 14 forming the channel in which the upper bar of the T rides or slides. Another method of affixing the supports 42, 44 to the cushion 14 is by use of parallel bands (not shown) of cloth or plastic to which the supports 42, 44 are secured. In this manner, by moving the bands the location of the supports 42, 44 can be adjusted. This last configuration is not shown in the drawings.

The cushion 14 of the invention is provided with the opening or break 38. This opening 38 is preferably located at the middle of the cushion 14, about five inches from the top or head of the cushion 14. The opening 38 can be about two inches in width and ten inches in length. This arrangement enables the head to rest essentially on the forehead, and possibly on the chin, and even on the cheek parts. This particularly allows the user to lie on the cushion 14 according to the invention, for an extended period of time, under very comfortable conditions. By this novel construction and arrangement of the invention the mouth and nose are unobstructed thereby assuring free breathing and more relaxed resting.

The adjustability of the cushion 14 of the invention allows each of the elements 32, 34, 42, 44 to be positioned at a suitable position with respect to the other, whilst assuring the stability of the whole. Under these conditions it will be possible for user to regulate the positioning of the elements as he wishes, and to obtain a position which is extremely comfortable, both from the point of view of his individual morphology and from that of that particular circumstance.

Another of the important features of the invention is that in a side laying position, the upper cushion goes all the way forward for neck support. The shoulder of user fits into opening 38. The lower cushion goes about three quarters of the way footward for ankle support.

While this invention has been described with particular reference to its use in a face down or face up position, it is obvious that it can be employed in other configurations and other modifications can be made without departing from the spirit and scope of the invention.

What is claimed is:

1. In a cushion for a lounge having cushion support members for supporting the cushion, said cushion having joined top and bottom sheets and parallel side sheets and first and second end sheets enclosing a cavity containing a resilient portion, the improvement which comprises incorporating on the cushion a first supine cervical or neck support which becomes a prone abdominal/lumbar support and a second supine knee support which becomes a prone ankle support, each said support being disposed at a right angle to the parallel side sheets, adjusting means for allowing these two supports to be moved in a horizontal direction along the surface of the cushion and to retain the position selected without movement, an aperture means near an upper end thereof which is adapted to receive a face of a user and permits a frontal support of the head of the user, a lower cushion portion and an upper cushion portion, and a stitched joint portion which is adapted to permit the regulation of an inclination of the upper cushion portion with respect to the lower cushion portion.

2. The cushion of claim 1, wherein the first and second supports are affixed to the top sheet of the cushion by the utilization of hook and eye fabric surface strips affixed to the top sheet of the cushion.

3. The cushion of claim 1, wherein the first and second supports are affixed to the top sheet of the cushion by two parallel tracks of fabric in each of which a runner is received, the tracks being affixed to the top sheet of the cushion allowing horizontal motion by the exertion of substantial force on the runners.

4. The cushion of claim 1, wherein the first and second support members each has a arcuate cover and a flat bottom cover and two end covers joined together and enclosing a space containing a resilient filler formed of an inflatable tube.

5. In a cushion for a lounge with an upper and lower end and having cushion support members for supporting the cushion, said cushion having joined top and bottom sheets and parallel side sheets and first and second end sheets enclosing a cavity containing a resilient portion, the improvement which comprises incorporating on the cushion a first supine cervical or neck support which becomes a prone abdominal/lumbar support and a second supine knee support which becomes a prone ankle support, each said support being disposed at a right angle to the parallel side sheets, adjusting means for allowing these two supports to be moved in a horizontal direction along the surface of the cushion and to retain the position selected without movement, an aperture means near then upper end of the lounge which is adapted to receive the face of a user and permits a frontal support of the head of such user, and wherein the first and second supports are held against the top sheet of the cushion by the utilization of an elastic band wrapped around the side sheets and the bottom sheet of the cushion and affixed at its ends to the support.

* * * * *